United States Patent [19]

Stevenson

[11] Patent Number: 4,497,367

[45] Date of Patent: Feb. 5, 1985

[54] LINER HANGER

[76] Inventor: Alan R. Stevenson, 12350 E. Montague St., Pacoima, Calif. 91331

[21] Appl. No.: 464,104

[22] Filed: Feb. 4, 1983

[51] Int. Cl.[3] ..... E21B 43/10

[52] U.S. Cl. ..... 166/208; 166/215

[58] Field of Search ..... 166/208, 210, 211, 215, 166/217, 214, 136, 137

[56] References Cited

U.S. PATENT DOCUMENTS

| | | | |
|---|---|---|---|
| 885,195 | 4/1908 | Staley | 166/215 |
| 2,228,503 | 1/1941 | Boyd et al. | 166/208 |
| 2,310,572 | 2/1943 | Burns | 166/137 X |
| 2,842,213 | 7/1958 | Burns | 166/208 |
| 2,877,850 | 3/1959 | Burns | 166/208 X |
| 2,916,092 | 12/1959 | Burns | 166/208 X |

*Primary Examiner*—James A. Leppink
*Assistant Examiner*—Michael Starinsky
*Attorney, Agent, or Firm*—Georges A. Maxwell

[57] ABSTRACT

A liner hanger having an elongate vertical body with a central flow passage means at its lower end engaged with a depending liner, releasable coupling means at its upper end releasably engaging a setting tool on a string of setting pipe. The body has a plurality of vertically extending circumferentially spaced radially outwardly opening recesses with upwardly and radially outwardly inclined ramp surfaces and elongate vertical passages between the upper end of the body and the recesses. The hanger next includes vertically extending slips with outer casing engaging surfaces and inner ramp surface engaging surfaces normally positioned in the lower portions of the recesses with their casing engaging surfaces aligned with the outside of the body. The slips are shiftable vertically upwardly and radially outwardly in the recesses. Spring means normally yieldingly urge the slips upwardly and outwardly in the recesses. Elongate push rods are slidably engaged in the passages in the body and releasing means are provided on the setting tool to releasably engage the upper ends and hold the rods down. Latch means are provided between the lower ends of the rods and the slips to hold the slips down when the rods are held down and releasing the slips for upward and outward movement when said releasing means releases and allows said rods to move upwardly in the passages.

14 Claims, 11 Drawing Figures

S
K
W
T
R
C
H
B
L
M
3
4
5
6
7
10
12
14
15
16
17
18
20
21
22
23
24
30
35
36
37
39
40
50
51
52
62
65
70
71
72
73
74
75
90
91

LINER HANGER

This invention has to do with an improved LINER HANGER for use in well structures.

BACKGROUND OF THE INVENTION

In modern deep well structures, elongate, substantially vertical holes or bores are drilled down into the earth and into structure or zones in the earth in which the oil, gas, water or steam to be produced by the wells is contained. It is common and well-known practice to support the earth defining the drilled bores of such wells with elongate strings of larger diameter casing pipe which often terminate above the production zones of the wells and to extend elongate strings of liner pipe, smaller in diameter than the casing pipe, down into the well bores below the lower ends of the casing pipes and into the production zones. Such liners are commonly lowered down through the casing pipes by elongate setting strings of drill pipe or the like and the upper end portions of the liners are connected to and with the lower end portions of the casings by means of liner hangers at the upper ends of the liners, whereby the liners are carried by and depend from the casings when released by the setting strings.

Liner hangers are tools which characteristically include elongate, vertically extending tubular bodies substantially equal in inner side diameter with the inside diameter of their related liners and which are slightly smaller in outside diameter than the inside diameter of the casings in which they are related. Accordingly, while the hanger bodies may have wall thicknesses which are greater than the wall thickness of their related liners and casings, their wall thickness and strength is quite limited.

The lower ends of the liner hanger bodies are commonly threadedly coupled with the upper ends of their related liners, while the upper ends thereof are commonly releasably coupled with the lower ends of their related setting strings by means of setting tools on those strings.

The bodies of one type or class of liner hangers are provided with upwardly and outwardly divergent, radially and downwardly disposed cone portions intermediate their ends and a plurality of circumferentially spaced wedges or slips which are less in vertical extent that the cone portions arranged about and carried by said cone portions. The slips are shiftable vertically from lower unactuated positions to upper actuated positions relative to the cone portions of their related hanger bodies and have inside surfaces which slidably engage said cone portions and have outside surfaces which occur at or inward of the exterior surfaces of the hanger bodies when the slips are in their unactuated positions and which engage the inside surfaces of their related casings when said slips are in their actuated positions. When the slips are in their actuated positions, they establish tight wedging engagement with and between their related casings and hanger bodies to effectively anchor or set the hangers with their liners depdnding therefrom, within their related casings. Movement of the slips in such tools, from their unactuated to their actuated positions, is effected by several different kinds and forms of setting tools and/or setting means which setting tools or means are, in most instances, operatively related to some releasable coupling means which is provided to couple the upper ends of the hanger bodies with their related setting strings provided to lower the liners and hangers into the wells.

While the above type or class of liner hanger has proven to be satisfactory to carry and support moderately heavy liners, the cone portions established in the liner hanger bodies so weaken the bodies that when they are subjected to the weight of liners, the weight of which is greater than moderate, they tend to deform or collapse inwardly when the slips are actuated and set in related casings. When the bodies of hangers deform or collapse in the manner suggested, they are rendered inoperative, ineffective to set and/or support the related liners.

In those instances where liners of greater than moderate or average weight are to be set in wells, use of another and special type or class of liner hanger is often resorted to. This special class of liner hanger differs from the previously described type or class of liner hanger in that the hanger bodies are provided with circumferentially spaced longitudinally extending slip receiving recesses with upwardly and outwardly inclined, radially outwardly and downwardly disposed slip engaging ramp surfaces, rather than with the aforementioned slip supporting cone portions. The provision of the noted slip recesses requires the removal of notably less material from the liner hanger bodies than is required to establish cone portions and therefore results in liner hanger bodies which are notably stronger and capable of supporting greater weight before the bodies will deform or collapse under radially inwardly disposed forces imposed upon them by the slips.

While the last noted special class of liner hangers are, as a general rule, stronger and capable of carrying heavier loads than the first noted class of liner hangers, they include features which limit their strength and which render them incapable of safely and effectively handling the ever-increasing weight of the "heavy" liner hangers now being used in wells.

In the above noted special class of liner hanger, the slips are characteristically normally yieldingly urged upwardly from unactuated or lower positions to actuated or upper positions by spring means carried by the hanger bodies below the recesses therein and engaging the lower ends of the slips. The slips are releasably held down in their unactuated position and against the resistance of the spring means by elongate vertical fingers on setting tools releasably coupled with the upper ends of the bodies. The fingers normally engage the upper ends of the slips to hold them down in their related recesses and against the force of the spring means. Since the noted fingers cannot be let to become obstructive and must occur inward of the exterior surfaces of their related hanger bodies, the hanger bodies are provided with elongate, vertically and radially outwardly opening grooves, between the slip recesses and the tops of the bodies to accommodate and protect the fingers. The noted grooves must extend down into the slip recesses to or below that line or point where the upper ends of the slips occur when the slips are in their unactuated or down position. Accordingly, the noted grooves necessarily extend through the upper portions of the inclined slip supporting ramp surfaces of the slip recesses and into and through the portions of the hanger bodies occurring directly inward of the slips, when the slips are in their actuated positions. It is those portions of the hanger bodies which must withstand the principal radially inwardly directly forces exerted onto and through the hanger bodies.

In practice, the vertical extent of the slips is equal to about one-half the vertical travel of the slips between their unactuated and actuated positions, the width of the fingers provided to hold the slips down is generally about one-quarter the width of the slips and the radial extent or depth of the grooves for the fingers is at least one-half the maximum depth of the recesses and/or one-half the maximum radial thickness of the slips. Accordingly, the portions of the grooves extending into the recesses generally leave about one-quarter of the central portions of the slips unsupported when the slips are in their upper actuated positions of the recesses.

As a result of the above, the noted grooves materially weaken the primary load-carrying portions of the hanger bodies and, by their very nature, establish break or bend lines in the hanger bodies, inward of and between opposite side portions of the slips which transmit the radially inwardly directed forces onto the bodies. Further, the extensions of the finger grooves in the hanger bodies above the slip recesses extend the break or bend lines in the bodies and so weaken and reduce the strength of the bodies above the recesses that little resistance to deformation of the bodies, inward of the slips, is afforded by the portions of the bodies above the slips.

In accordance with the above, it is apparent that the special form or class of liner hanger noted above have inherent weaknesses.

In addition to the foregoing, the longitudinal extent of the slip-engaging fingers is limtied to that length which imparts into the fingers sufficient rigidity and strength so that the fingers will not flex or bend out of engagement in their related grooves and cannot be washed, bent or dragged from engagement in said grooves by fluids and obstructions likely to be encountered in well structures. This limitation imposed upon the slip fingers works to limit the longitudinal extent of the portions of the hanger bodies which occur above the slips and with which the setting tools for the hangers are commonly engaged. As a result of the foregoing, it is not infrequent that the slips in such liner hangers are so closely related to the setting tools that if the hanger bodies yield inwardly, as and when the slips are set, proportions of the bodies, above the slips and within which the setting tools are related, yield or collapse to such an extent that the setting tools bind or are otherwise rendered inoperative. When the above occurs, costly fishing operations must be undertaken to retrive the setting tools, liner hangers and liners from within the wells. To overcome the above, and to enable the longitudinal or vertical spacing of parts and portions of the liner hangers and the setting tools to be increased, the length of the upper portions of the hanger bodies have been increased and the slips have been provided with upwardly projecting fingers which extend through the lower portions of related grooves in the hanger bodies to releasably engage the lower ends of the fingers of the setting tools engaged in the upper ends of the grooves. This practice has allowed the length of said upper portions of the hanger bodies, occurring above the slips, to be substantially doubled and has proven to be an improvement, but it is not a sufficient improvment to enable those liner hangers to effectively support those heavy loads which are now being encountered, without a likelihood of failure.

In practice, the slip engaging fingers are, at best, sufficiently long and fragile so that following actuation of the setting tools and disengagement of the fingers from their related grooves, the fingers are frequently mutilated or damaged to such an extent that they must be replaced before the setting tool can be used again. The difficulty and the cost of replacing those fingers is substantial.

In practice, liner hangers are provided with one or a plurality of longitudinally spaced sets of slips. Each set of slips most commonly includes three or four circumferentially spaced slips with related recesses, grooves and fingers. The space between adjacent recesses and/or slips of each set of slips is generally insufficient to accommodate finger-accommodating grooves for a next lower set of slips. Accordingly, where more than one set of slips is provided, it is necessary and common practice to arrange the slips of each lower set of slips so that the lower edges of slips of the next above set of slips engage and normally hold the lower slips down. Accordingly, grooves and fingers need only be provided for the uppermost set of slips. The great disadvantage of the above practice resides in the fact that substantial and most advantageous longitudinal spacing of sets of slips is prevented and excessive weakening of the hanger bodies is brought about by the close relationship of the vertically related slip recesses.

In instances where the circumferential spacing of the slips of an upper set of slips has been increased to accomodate the establishment of finger grooves for a next lower set of slips, the additional and longer grooves for the lower set of slips greatly weakens the hanger bodies where maximum strength should be maintained and the fingers for the lower sets of slips must be made so long and fragile that they are subject to being displaced before the hangers are in place and ready to be set.

In those situations where the weight of liners could be set is greater than the weight ordinary or commercial available liner hangers can support are encountered, well drillers have resorted to the purchase and use of custom made liner hangers which, to the best of my knowledge and belief, are not materially different in design and construction from ordinary, commercially available liner hangers, but are made of costly and/or exotic materials under rigid quality control standards. The cost of one such custom made liner hanger is understood and believed to be approximately $40,000.00. That hanger was used in a well structure where an ordinary commercially available liner hanger costing approximately $5,000.00 would have been used, if such an ordinary hanger could be relied upon to carry the anticipated weight of the liner being handled. That liner is understood to have been a 12½" liner, 6,000 ft. long and weighing about 284,000 lbs. The liner hanger, in this case, was subjected to a maximum load of about 350,000 lbs. when the slips were being set and the weight of the setting string was imposed upon the hanger to set the slips in tight wedging engagement between the hanger body and casing.

In the foregoing, reference to those weights of liners which are of moderate to heavy weight and reference to the strength and weight carrying capacity of various liner hangers necessarily refers to such factors in a general sense and is intended to point to certain of those factors which adversely affect the utility of most commonly used and commercially available liner hangers provided by the prior art. It is recognized that in certain instances and/or under certain circumstances, exceptions to the foregoing might be found.

OBJECTS AND FEATURES OF MY INVENTION

An object of my invention is to provide an improved liner hanger of that class of liner hanger which includes a body with recesses in which casing engaging slips are slidably engaged; in which spring means are provided to normally yieldingly urge the slips up from lower unactuated positions to upper actuated positions in their related recesses; in which a setting tool is provided to releasable engage the upper end of the body and which carries depending fingers to releasably hold the slips in their unactuated positions; and a linger hanger in which the body is formed with vertical, cylindrical passages which extend between said recesses and the setting tool and in which the setting tool fingers are releasably engaged and in which push rods are slidably carried to act between the fingers and the slips.

Another object of my invention is to provide an improved liner hanger of the general character referred to above which is capable of supporting loads equal to the loads which presently require the use of custom made liner hangers, the cost of which is four to five times the price at which the liner hanger that I provide can be profitably sold.

It is an object and feature of this invention to provide a liner hanger of the character referred to wherein said passages in the body eliminate the forming of outwardly opening longitudinally extending finger receiving grooves in the exterior of the body, as is common practice in the prior art and wherein the volume of material removed from the body to establish the passages and the cross-sectional extent of those passages is a small fraction of the volume of material removed to establish those finger accommodating grooves of substantially greater cross-sectional extent provided by the prior art whereby the hanger body is notably stronger and capable of supporting materially greater loads than comparable liner hangers of the prior art.

Yet another object and feature of the invention is to provide an improved liner hanger structure of the general character referred to wherein the noted push rods slidably engaged in said passages are contained within those passages against deformation and/or displacement whereby the passages and rods can be of substantially any desired length whereby the longitudinal or vertical spacing and placement of various other parts and portions of the liner hanger structure related to the passages and rods can be varied and/or adjusted as desired or as circumstances require.

Still another object and feature of this invention is to provide an improved liner hanger structure of the general character referred to wherein the longitudinal extent of the fingers on the setting tool need be no greater in longitudinal extent than the distance the slips must be moved to effect disengagement of the rods with the slips whereby the fingers of the setting tool can be short, durable, unobstructive parts and can be easily and economically manufactured, serviced and/or maintained.

Finally, it is an important feature of this invention to provide an improved liner hanger of the general character referred to which is such that its cost of manufacture is not materially different or greater than the cost of manufacturing comparable commercially available liner hangers provided by the prior art and is such that the anticipated cost of servicing, repairing and maintaining the hanger structure is less than the cost of servicing, repairing and maintaining comparable liner hangers provided by the prior art.

The foregoing and other objects and features of my invention will be fully understood from the following detailed description of one typical preferred form and embodiment of the invention, throughout which description reference is made to the accompanying drawings.

DETAILED DESCRIPTION OF THE INVENTION

Figures 1, 2, 3:
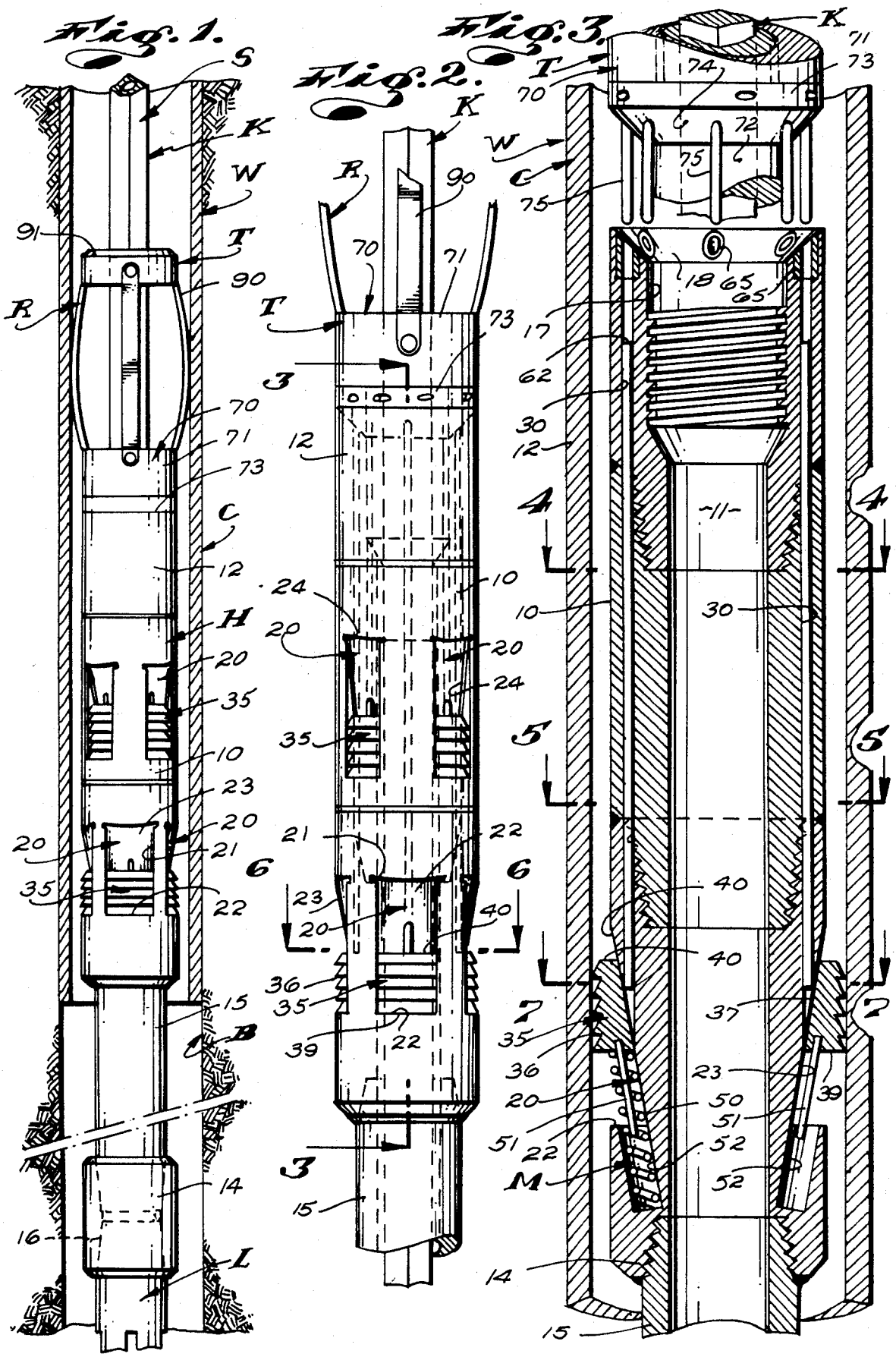
FIG. 1 is a longitudinal sectional view of a well structure showing my new liner hanger engaged therein.
FIG. 2 is an enlarged view of the liner hanger shown in FIG. 1.
FIG. 3 is an enlarged detailed sectional view taken substantially as indicated by line 3—3 on FIG. 2 with parts shown in different positions.
Figure 4:
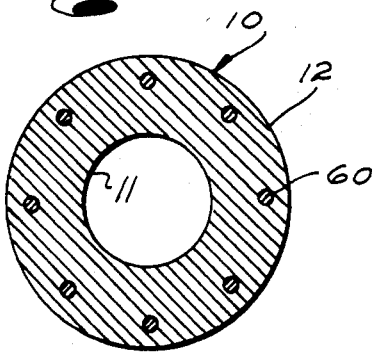
FIGS. 4 and 5 are sectional views taken as indicated by lines 4—4 and 5—5 on FIG. 3.
Figure 5:
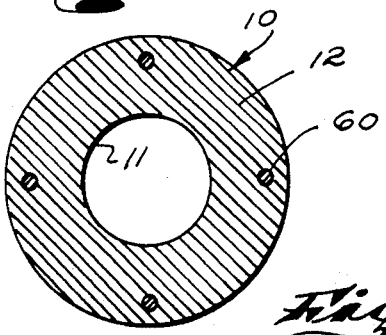
Figure 6:
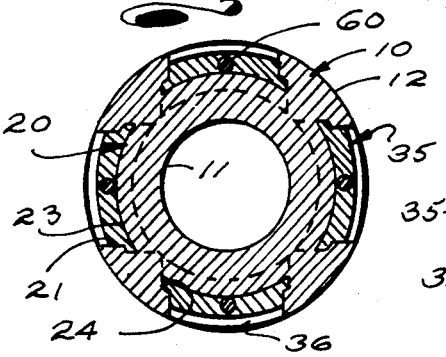
FIG. 6 is an enlarged cross-sectional view taken substantially as indicated by line 6—6 on FIG. 2.
Figure 7:
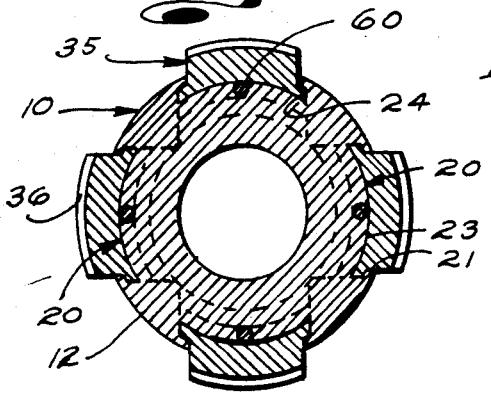
FIG. 7 is a sectional view taken as indicated by line 7—7 on FIG. 3.

Referring to FIG. 1 of the drawings, the liner hanger H that I provide is shown engaged on the upper end of a liner L and is shown carried by a setting tool T carried by a part or element K of a setting string S. The above structure is shown arranged in a well W with the hanger H, tool T and string S within the lower end portion of a casing C set within the bore B of the well and with the liner L depending freely into the bore B below the hanger and the casing. The hanger H is shown in its unactuated position.

Referring to FIG. 2 of the drawings, certain details of the hanger construction are shown in dotted lines.

Referring to FIG. 3 of the drawings, the liner hanger is shown in its other or actuated position and is shown in cross-section to better illustrate details of the construction.

The liner hanger H includes an elongate tubular body 10 with a cylindrical wall defining a vertical central passage 11 and an exterior cylindrical surface 12. The outside diameter of the body is sufficiently less than the inside diameter of the casing C in the well W to enable the hanger to be lowered through the casing and down into the well structure. The inside diameter of the body or of the passage 11 therein is preferably equal to the inside diameter of the liner L and such that tools to be lowered into the liner can be freely moved through the hanger.

The upper end of the liner is threadedly engaged into the lower end of the body 10 or can be threadedly engaged into and carried by a coupling sleeve 14 at the lower end of a depending extension 15 on the body and as shown at 16 in FIG. 1 of the drawings.

The upper end portion of the body 10 is provided with an enlarged internally threaded setting tool receiving bore 17 and an annular downwardly and inwardly convergent or conical stop seat 18 for the setting tool T at and about the open top of the bore 17.

The body 10 next includes two vertically spaced sets of radially outwardly opening vertically extending slip receiving recesses 20 between its upper and lower ends. In the case illustrated, each set of recesses includes four circumferentially spaced recesses. The upper set of recesses is spaced well below and clear from the upper bore 17 in the body and well above and clear from the lower set of recesses whereby the noted spaced apart parts or portions of the construction are independent and unlikely to have any effect upon each other as regards the load carrying capacity of the body. The two sets of slip receiving recesses are circumferentially offset 45° so that the central vertical axes of the lower recesses extend midway between related adjacent recesses of the upper set of recesses.

The recesses 20 are defined by circumferentially spaced opposing parallel sides 21, circumferentially extending vertically disposed bottom sides 22 and radially upwardly and outwardly inclined radially outwardly and downwardly disposed inside or ramp surfaces 23. The ramp surfaces 23 extend upwardly from the inner edges of the bottom sides to converge with the exterior surface 12 of the body 10 at the upper limits of the recesses. In practice, the sides 22 of the recesses are provided with retaining channels 24.

Opening at the bottom 23 of each slip recess 20 and extending downwardly therefrom and into the body is a drilled opening 25 which is a part of a spring means M, which will hereinafter be described.

Finally, the body 10 is provided with an elongate vertically extending cylindrical passage 30 on the central vertical radial plane of each recess 20 and extending between and opening at the seat 18 at the top of the body and the ramp surface 23 of its related recess, substantially centrally thereof.

The body 10 described above can be made in one part or can, as shown, be fabricated of several parts as desired or as circumstances require and without departing from the spirit of my invention.

The cylindrical passages 30 might be established in any suitable manner. In practice, the passages 30 have been established by gun drilling the passages in the body from the seat 18 to their related recesses. Gun drilling of the passages has proven to be a suitably fast and quite economical machining operation. The passages 30 thus established are very straight, uniform and smooth and are such that a length of drill rod or the like of suitable diameter can be engaged within the passages with assurance that smooth and free sliding engagement of the rods in the passages will be provided for.

The liner hanger H next includes casing engaging slips 35. There is one slip 35 slidably engaged in and carried by each recess 20. Each slip 35 has a radially outwardly disposed semicylindrical surface 36 which is curved about an axis parallel with the central axis of the hanger H and the casing C with a radius equal to the radius of the inside diameter of the casing so that when the slip is moved radially outward relative to the body and into engagement with the inside surface of the casing, the surface 36 establishes uniform engagement with said casing.

In practice, and as shown, the casing engaging surfaces 36 of the slips 35 are formed with uniform patterns of vertically spaced circumferentially extending ribs with downwardly and outwardly disposed casing engaging edges to bite into the surface of the casing when the slips are urged into set engagement therewith.

Each slip 35 next includes an upwardly and outwardly inclined upwardly and radially inwardly disposed conical inside surface 37 which establishes uniform opposing sliding engagement with the ramp surface 23 of its related recess 20. Each slip 35 next includes opposite sides 38 which oppose and slidably engage opposite sides 21 of its related recess; a flat bottom edge 39 which opposes the bottom 22 of its related recess; and an upwardly disposed top edge or surface 40.

In practice, and as shown in the drawings, the side edges of the slips are provided with retaining flanges which are slidably engaged in the grooves 24 of the recesses and which serve to prevent the slips from freely shifting radially and out of engagement from within their recesses.

The wedge-like slips are of limited vertical and radial extent so that when they are in their down or unactuated positions in their related recesses, with their lower edges 39 stopped at the bottoms 22 of the recesses, their outer surfaces 36 occur at or radially inward of the exterior surface 12 of the body and the top edges or surfaces 40 thereof occur below and underlie the lower open ends of the passages 30 and are such that when they are moved up in their related recesses from their unactuated to their upper actuated positions, they are moved radially outward relative to the body 10 and into engagement with the casing C. When in their up or actuated positions, the slips move above and overlie the lower open ends of their related passages 30.

The above noted spring means M provided to normally yieldingly urge the slips up in their related recesses can vary widely in form. In the case illustrated, the means M includes elongate vertical helical compression springs 50 with lower end portions arranged in stopped position in the above noted openings 25 at the bottoms of the recesses and with upper ends engaging the bottom edges 39 of the slips. The slips are provided with and carry depending retaining pins 51 which extend centrally through the springs 50 and into the openings 25 to prevent displacement of the springs.

The hanger H next includes elongate cylindrical vertical push rods 60 slidably engaged in the passages 30. The rods 60 have lower end portions which normally project outward from the lower open ends of the passages 30 into the recesses 20 and which have downwardly disposed ends or stop surfaces 61 which establish stopped engagement with the upper edges or surfaces 40 of the slips when the slips are in their lower unactuated positions. The upper ends 62 of the push rods 60 normally terminate within the upper portions of the passages in limited predetermined spaced relationship below the seat 18 of the body so that when the rods are moved upwardly a sufficient distance to move their lower end portions up and out of the confines of the recesses and from engagement with the surfaces 40 of the slips, the upper ends of the rods remain within the passages.

Figure 8:
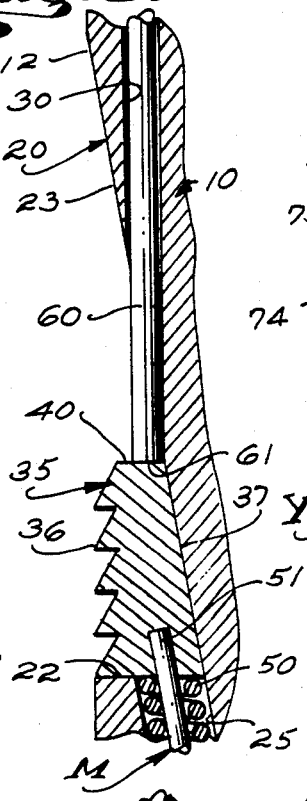
FIGS. 8 and 9 are enlarged detailed sectional views of a portion of the construction shown on FIG. 3 and showing parts in two different positions.
Figure 9:
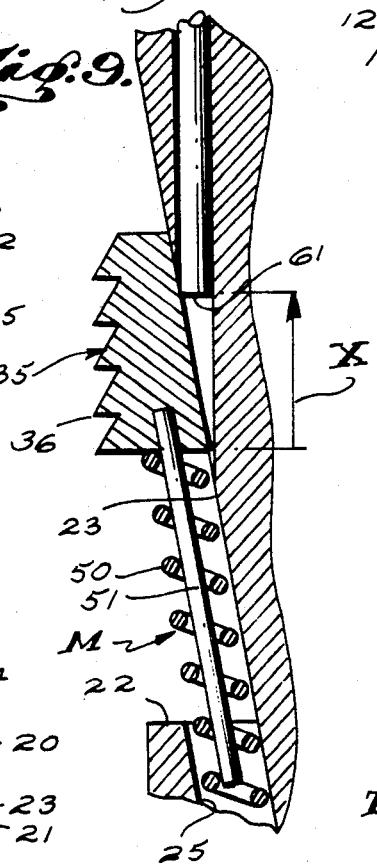

Referring to FIGS. 8 and 9 of the drawings, it will be apparent that the required movement of the rods 60 to effect releasing of the slips and actuation of the hanger is limited and need not be greater than the distance indicated by the arrow X in FIG. 9 of the drawings. Accordingly, the structure need only provide for corresponding free vertical movement of the upper ends of the rods, as indicated by the arrow Y in FIG. 10 of the drawings. It is important to note that the rods 60 which serve to normally engage and hold the slips down need only be capable of withstanding longitudinally imposed compressive forces which are sufficient to hold the slips down and against the resistance of the spring means M. The rods are slidably engaged and are held captive within their related passages 30 and cannot bow, bend or otherwise be deformed or become displaced and need not be embodied with any great rigidity and strength to resist lateral forces and the like. Accordingly, the rods can be quite small in diameter and the passages therefor are equally small and require the removal of very little stock from the body to establish them. The cylindrical cross-section of the passages 30 and their position or arrangement well within the mass of the body 10 provides a geometrical strong and stable structure in which the passages work negligible adverse effects on the ultimate strength and capacity of the body to withstand radially inwardly directed compressive forces.

The principal limitation on the size of the rods 60 resides in the fact that their lower ends must present sufficient surface area to establish positive and secure stopped engagement with the surface 40 of their related slips. This being the case, it is apparent that by using supplemental stop or latch means at and between the lower ends of the rods and the slips, the passages 30 and rods 60 might be made notably smaller than is depicted in the drawings.

In the form of the invention illustrated and to prevent the rods 60 from accidentally moving up and out of their related passages 30, the upper ends of the passages are shown provided with plug-like annular stops 65, the inside diameter of which is slightly smaller than the outside diameter of the rods and which therefore prevent upwardly movement and displacement of the rods. The stops 60 are of limited axial or vertical extent and require slight lengthening of the construction. To date, it has not been determined that the noted stops 65 or equivalent rod retaining means are necessary or will be required in all instances. Provision of the stops 65 is to adhere to the established practice of keeping all parts of well tools contained wherever possible.

The setting tool T provided to set the hanger H and which is or can be properly considered to be a part of the overall liner hanger construction comprises an elongate setting nut 70 with an enlarged cylindrical head 71 which normally occurs above the upper end of the hanger body 10 and a threaded shank 72 which is normally releasably threadedly engaged in the bore 17 of the body 10. The setting nut 70 has a central vertical polygonal opening in and through which an elongate polygonal fluid conducting Kelly pipe is engaged for free axial movement and for rotary driving engagement therebetween. The Kelly pipe K is engaged on the lower end of and is carried by the elongate setting string S, utilized to lower and set the liner L and hanger H within the wells W. For the purpose of this disclosure, the Kelly pipe K can be viewed and considered as being a part of either the setting string S or the tool T, as desired.

The lower end of the Kelly pipe K is provided with a stop shoulder or the like (not shown) to prevent excessive downward movement and displacement of the nut relative thereto.

The setting tool T next includes an annular finger or setting ring 73 rotatably engaged about the upper end of the shank 72 and below the head 71 of the nut 70 and formed with a downwardly and radially inwardly inclined or conical lower surface 74 which cooperatively engages the conical seat 18 at the top of the hanger body 10.

The setting ring 73 carries a plurality of circumferentially spaced elongate, vertical fingers 75 which depend from the ring into the upper portions of the passages 30 and into stopped engagement with the upper ends 62 of the push rods 60. Thus, the fingers serve to normally hold the rods and their related slips 35 down and in their unactuated positions. The fingers 75 carried by the ring 73 are short, self-supporting rigid rods and need only be as long as the distance the rods must travel to effect actuation of the slips, plus the length of the stops 65 at the tops of the passages 30, if such stops are provided. The diameter of the rods need only be such that they are freely slidable in and through the stops and into the upper end portions of the passages 30.

It will be apparent that the nut 70 of the tool T is rotatable relative to the ring 73 and that the head 71 of the nut 70 normally holds the ring and its fingers down and in engagement with the body 10 and with the rods 60. It will be further apparent that upon turning the nut 70 out of engagement with the body 10 by rotation of the string S and Kelly pipe K, the ring 73, with its depending fingers, does not rotate but is free to move upwardly with the nut 70.

Figure 10:
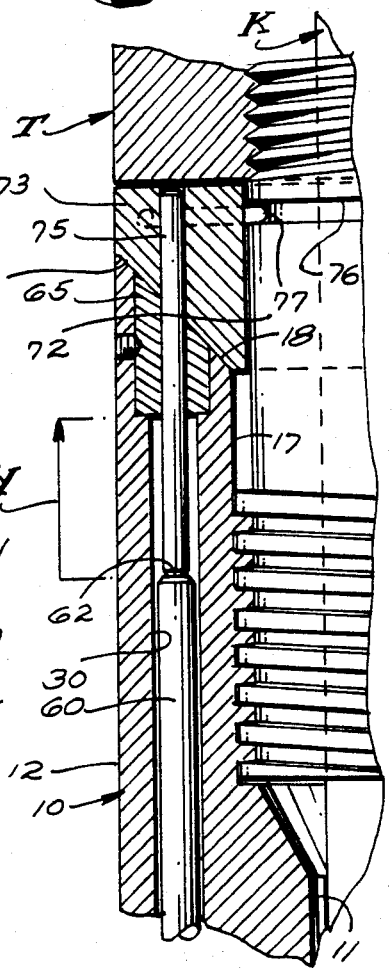
FIG. 10 is an enlarged detailed sectional view of another portion of the construction.

While the force exerted by the multiplicity of spring means M is sufficient to effect raising of the ring and the fingers, movement of the ring and fingers up with the nut 70 can be assured by means of an annular groove 76 in the upper portion of the shank of the nut and circumferentially spaced stop pins 77 carried by the ring and projecting freely into the groove, as clearly shown in FIG. 10 of the drawings.

Figure 11:
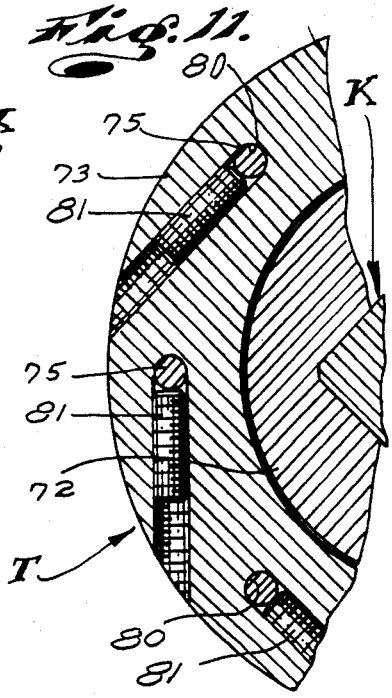
FIG. 11 is an enlarged detailed sectional view of a portion of the setting tool.

In the form of the invention illustrated and as clearly shown in FIGS. 10 and 11 of the drawings, the setting ring is provided with drilled vertical openings 80 in which upper extensions of the fingers are slidably engaged. The upper extensions of the fingers are releasably locked in position in the openings 80 by set screws 81, as clearly shown in FIG. 11 of the drawings.

With the construction noted above and illustrated in the drawings, it will be apparent that if and when the stop pins are bent, worn or damaged, they can be easily and quickly replaced with new pins.

In practice, if and when the liner L is seated on the bottom of the well bore B or is otherwise stopped against rotation in the well. Relative rotation of the setting tool relative to the hanger body, to effect actuation of the slips, presents no problem. In those instances where the liner L is not held or stopped against rotation in the well structure and relative rotation between the setting tool T and the hanger body 10 will not occur when the setting string is rotated, means must be provided to stop rotation of the setting tool and to thereby effect relative rotation between the setting tool and the hanger body when the setting string S, setting tool T and liner L are rotated. To this end, the setting tool T can, as shown in the drawings, be provided with restraining means R to engage the interior of the casing C and to prevent relative rotation of the nut 70 of the tool T relative to the casing. The restraining means R can vary widely in practice and is shown as including a plurality of circumferentially spaced elongate vertical belly springs 90 with lower ends secured to the upper end of the nut 70 and with upper ends secured to a carrier ring 91 spaced above the nut 70. The belly springs 90 are bowed radially outwardly between their ends so that they yieldingly frictionally engage the interior of the casing C. The cumulative frictional force generated between the springs 90 and the casing is substantially greater than the frictional drag of the threaded connection between the nut 70 and the body 10. Accordingly, upon rotation of the spring S, the Kelly pipe K, the hanger H and the liner L in and relative to the casing, the nut 70 is held against rotation and the hanger body 10 is rotated or turned from threaded engagement therewith to effect actuation of the liner hanger.

Apart from the novel means that I provide to releasably hold the slips 35 down in their lower unactuated position, the liner hanger H that I provide need differ little in construction from various other liner hangers provided by the prior art. Use and operation of my new hanger is essentially the same as is the use and operation of prior art liner hangers. Accordingly, further detailed description of the construction and operation of my liner hanger would only serve to unduly burden this disclosure and will therefore be dispensed with.

By providing my liner hanger with the above noted and described novel means for releasably holding the slips down, my new liner hanger is capable of safely and effectively supporting vertically directed loads which are approximately twice as great as the loads which can be safely and effectively supported by liner hangers of similar size, made of similar materials and of like quality wherein the means provided to releasably hold the slips down comprise slip engaging fingers arranged in radially outwardly opening vertical grooves machined and entering the exterior surfaces of the hanger bodies.

Having described only one typical preferred form and embodiment of my invention, I do not wish to be limited to the specific details herein set forth but wish to reserve to myself any modifications and/or variations that might appear to those skilled in the art and which fall within the scope of the following claims:

Having described my invention, I claim:

1. A liner hanger comprising an elongate vertical body with upper and lower ends, a central longitudinal flow passage, a cylindrical exterior surface, coupling means at its lower end engaged with the upper end of a depending liner, releasable coupling means at and within its upper end with a threaded part releasably engaging a threaded part of a setting tool on an elongate upwardly extending setting string of pipe, a plurality of elongate vertically extending circumferentially spaced radially outwardly opening recesses with radially outwardly and downwardly disposed upwardly and radially outwardly inclined ramp surfaces in the exterior of the body and positioned longitudinally thereof in vertical spaced relationship below said releasable coupling means and elongate vertical passages in the body and opening upwardly at the upper end of the body and intersecting and opening at the ramp surfaces of related recesses; elongate vertically extending slips with upper and lower ends, outer semi-circular casing engaging surfaces and ramp surface engaging inner surfaces normally positioned in the lower portions of and shiftable vertically upwardly and radially outwardly in related recesses; spring means normally yieldingly urging the slips upwardly and outwardly in the recesses; elongate vertical push rods with upper and lower ends slidably engaged in the passages; releasing means on the setting tool releasably engaging the upper ends of the rods and holding the rods down in the passages with their lower end portions normally projecting into their related recesses and with their lower ends releasably engaging upwardly disposed stop surfaces on the slips and releasably holding the slips down and releasing the slips for upward and outward movement in the recesses when said releasing means releases and allows said rods to move upwardly in the passages.

2. The liner hanger set forth in claim 1 wherein the upper ends of the slips define said upwardly disposed stop surfaces.

3. The liner hanger set forth in claim 1 wherein said releasing means includes elongate vertical fingers depending from the setting tool into the upper end portions of the passages and into stopped engagement with the upper ends of the rods and shiftable vertically from engagement with the rods and from within the passages.

4. The liner hanger set forth in claim 1 wherein said setting tool comprises a releasing nut on the setting string of pipe in rotary driving engagement therewith, said nut has a shank threadedly engaged in the upper end of the body, said releasing means comprises a ring rotatably carried by the nut and elongate vertical fingers carried by the ring engaged in the upper portions of the passages in engagement with the rods and shiftable upwardly from engagement with the rods and from the passages upon rotation of the setting string and the nut and upward movement of said nut relative to the body.

5. The liner hanger set forth in claim 4 wherein the upper ends of the slips define said upwardly disposed stop surfaces.

6. The liner hanger set forth in claim 1 wherein the lower ends of the passages intersect and open at the ramp surfaces of the recesses at positions above the upper ends of the slips when the slips are in the lower portions of their related recesses and radially inward of the slips when said slips are moved upwardly and outwardly in the recesses.

7. The liner hanger set forth in claim 3 wherein the lower ends of the passages intersect and open at the ramp surfaces of the recesses at positions above the upper ends of the slips when the slips are in the lower portions of their related recesses and radially inward of the slips when said slips are moved upwardly and outwardly in the recesses.

8. The liner hanger set forth in claim 3 wherein the lower ends of the passages intersect and open at the ramp surfaces of the recesses at positions above the upper ends of the slips when the slips are in the lower portions of their related recesses and radially inward of the slips when said slips are moved upwardly and outwardly in the recesses.

9. The liner hanger set forth in claim 4 wherein the lower ends of the passages intersect and open at the ramp surfaces of the recesses at positions above the upper ends of the slips when the slips are in their lower portions of their related recesses and radially inward of the slips when said slips are moved upwardly and outwardly in the recesses.

10. The liner hanger set forth in claim 1 wherein the upper ends of the rods occur below the upper ends of the passages and which further includes stop means at the upper ends of said passages limiting upward movement of the rods from within said passages and which freely accommodate parts of said releasing means.

11. The liner hanger set forth in claim 2 wherein the upper ends of the rods occur below the upper ends of the passages and which further includes stop means at the upper ends of said passages limiting upward movement of the rods from within said passages and which freely accommodate parts of said releasing means.

12. The liner hanger set forth in claim 4 wherein the upper ends of the rods occur below the upper ends of the passages and which further includes stop means at the upper ends of said passages limiting upward movement of the rods from within said passages and which freely accommodate parts of said releasing means.

13. The liner hanger set forth in claim 4 wherein the upper ends of the rods occur below the upper ends of the passages and which further includes stop means at the upper ends of said passages limiting upward movement of the rods from within said passages and which freely accommodate parts of said releasing means.

14. The liner hanger set forth in claim 5 wherein the upper ends of the rods occur below the upper ends of the passages and which further includes stop means at the upper ends of said passages limiting upward movement of the rods from within said passages and which freely accommodate parts of said releasing means.

* * * * *